US005340325A

United States Patent [19]

Pai

[11] Patent Number: 5,340,325

[45] Date of Patent: Aug. 23, 1994

[54] CAPACITIVE COUPLED BNC TYPE SELF-TERMINATING COAXIAL CONNECTOR

[76] Inventor: Tien-Fa Pai, No. 7, Alley 28, Lane 281, Hwa Cheng Road, Hsin Chuang City, Taipei Hsien, Taiwan

[21] Appl. No.: 112,591

[22] Filed: Aug. 26, 1993

[51] Int. Cl.[5] ..... H01R 13/66

[52] U.S. Cl. ..... 439/188; 439/620

[58] Field of Search ..... 439/188, 609, 610, 620; 200/51.1

[56] References Cited

U.S. PATENT DOCUMENTS 5,108,300 4/1992 Weber ..... 439/188
5,145,412 9/1992 Tan et al. ..... 439/620
5,167,536 12/1992 Wang ..... 439/620

*Primary Examiner*—Z. R. Bilinsky
*Attorney, Agent, or Firm*—Bucknam and Archer

[57] ABSTRACT

A coaxial connector including capacitor elements inserted in holes on an insulative inner shell thereof and corresponding holes on a stepped contact metal cylinder thereof and disposed in contact with a central contact being received within an insulative hollow core thereof inside the stepped contact metal cylinder, and a resistor element inserted in a hole on the stepped contact metal cylinder and a corresponding hole on the insulative hollow core and disposed in contact a projecting spring strip on the central contact via a contact metal strip on the insulative hollow core, whereby the projecting spring strip is disconnected from the contact metal strip and the resistor element as the coaxial connector is connected with a matching connector.

3 Claims, 5 Drawing Sheets

CAPACITIVE COUPLED BNC TYPE SELF-TERMINATING COAXIAL CONNECTOR

BACKGROUND OF THE INVENTION

The present invention relates to a BNC type coaxial connector, and more particularly to a capacitive coupled BNC type self-terminating coaxial connector.

Various coaxial connectors have been disclosed for use in computers. Because a computer requires high quality transmission, a filter device is needed for a coaxial connector to eliminate noises. There are known BNC type coaxial connectors which are coupled with capacitor elements to eliminate noises. There is also known capacitive coupled BNC type coaxial connectors which commonly use a resistor element for self-terminating control. A capacitive coupled BNC type self-terminating coaxial connector will be automatically electrically connected as a matching connector is fastened thereto, on the contrary, it will be automatically electrically disconnected as the matching connector is removed therefrom. However, these conventional capacitive coupled BNC type self-terminating coaxial connectors are commonly complicated in structure, and the capacitor and resistor elements may be shifted from place easily causing a contact error.

SUMMARY OF THE INVENTION

The present invention has been accomplished under the aforesaid circumstances. According to one aspect of the present invention, a contact metal strip is fastened in an insulative hollow core inside a stepped contact metal cylinder of the connector and disposed in contact with a resistor element, and a projecting spring strip is made on the central contact of the connector and disposed in contact with the contact metal strip to electrically disconnect the connector, whereby the projecting spring strip is disconnected from the contact metal strip as a matching connector to be is connected thereto, causing the connector electrically connected.

According to another aspect of the present invention, capacitor elements are inserted in holes on the stepped contact metal cylinder and disposed in contact with the central contact to eliminate outside noises.

DETAILED DESCRIPTION OF THE PREFERRED EMBODIMENT

Figure 1:
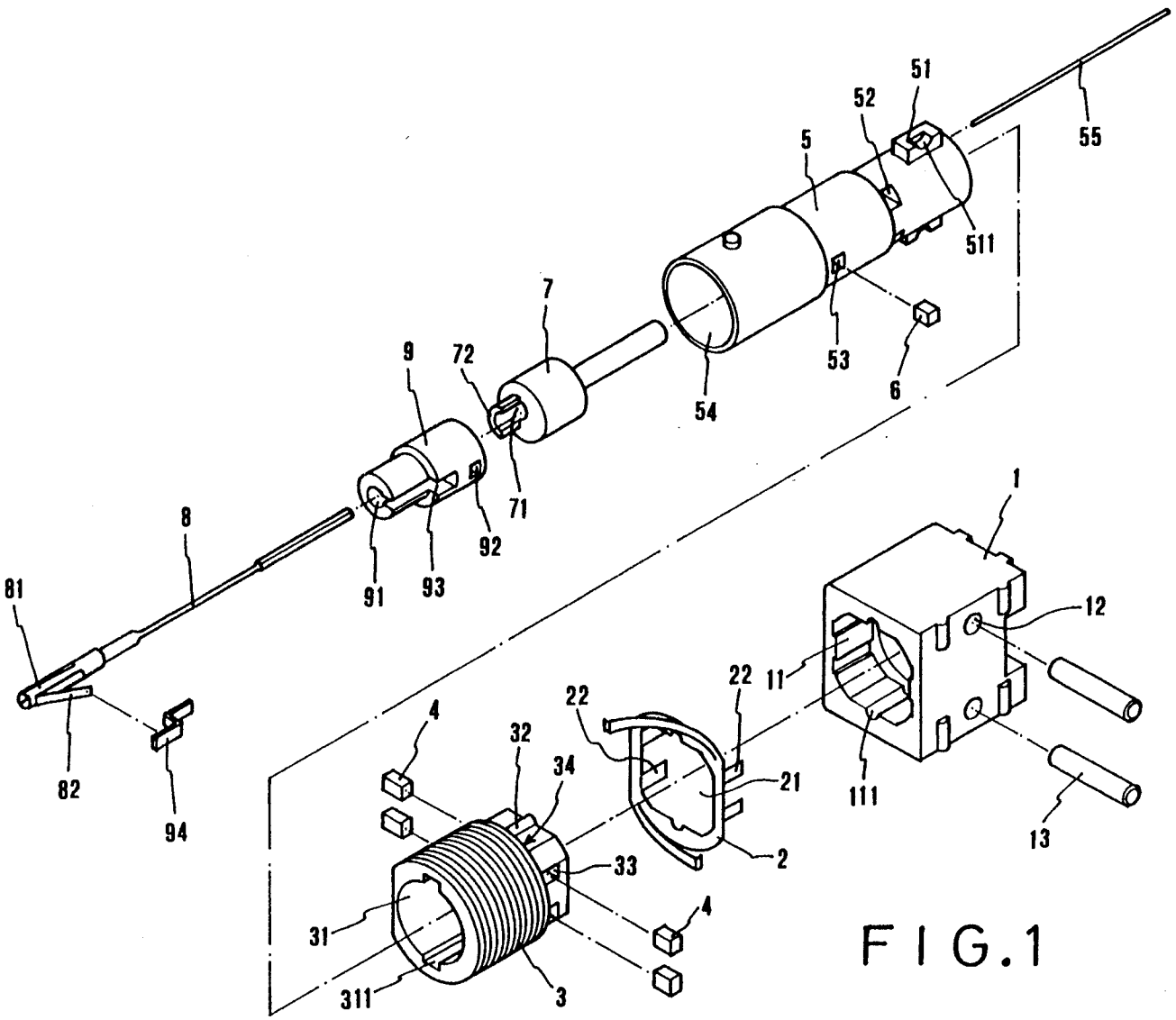
FIG. 1 is an exploded view of a capacitive coupled BNC type self-terminating coaxial connector according to the present invention.
Figure 2:
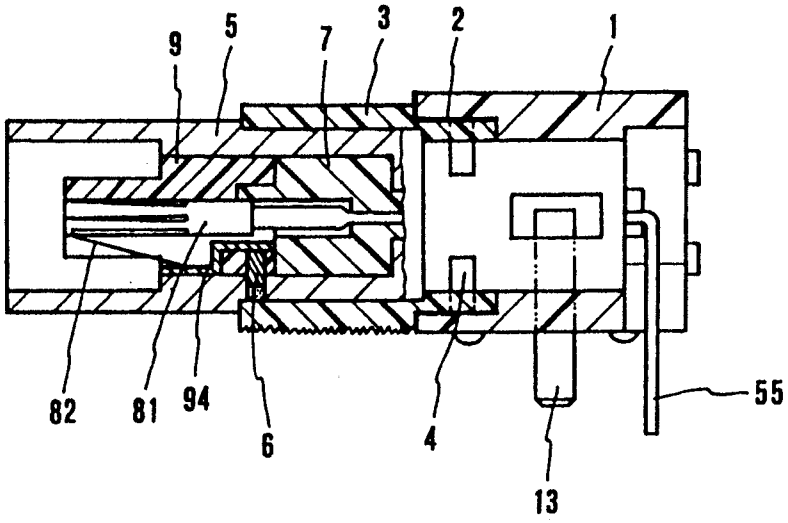
FIG. 2 is a perspective sectional side view of the capacitive coupled BNC type self-terminating coaxial connector shown in FIG. 1.
Figure 3:
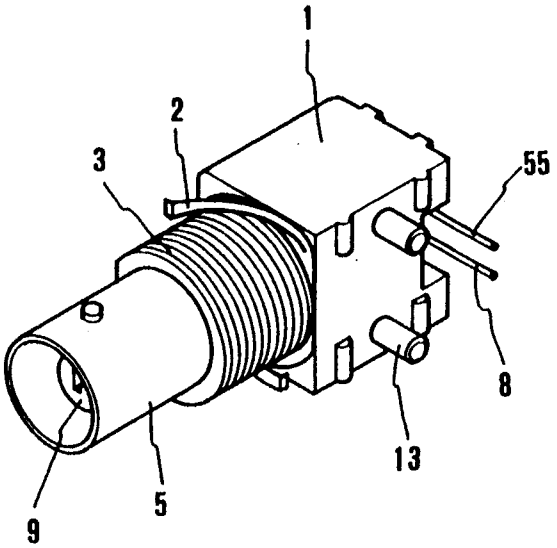
FIG. 3 is an elevational view of the capacitive coupled BNC type self-terminating coaxial connector shown in FIG. 1.

Referring to FIGS. 1, 2, and 3, a capacitive coupled BNC type self-terminating coaxial connector in accordance with the present invention is generally comprised of an insulative outer shell 1, a contact metal spring 2, an insulative inner shell 3, capacitor elements 4, a stepped contact metal cylinder 5, a resistor element 6, an insulative hollow insert 7, a central contact 8, and an insulative hollow core 9.

The insulative outer shell 1 is fabricated, for example, by molding, comprising a center through hole 11, which receives the insulative inner shell 3 and the stepped contact metal cylinder 5, two opposite longitudinal grooves 111 on the inside of the center through hole 11 for the positioning of the insulative inner shell 3 and the stepped contact metal cylinder 5 respectively, two plug holes 12 on one lateral side thereof disposed in communication with the center through hole 11, and two earth contact legs 13 respectively inserted in the plug holes 12.

The contact metal spring 2 comprises a center opening 21 corresponding to the center through hole 11 of the insulative outer shell 1, and a plurality of unitary pegs 22 for connection with capacitor elements 4.

The insulative inner shell 3 is made in a hollow structure, comprising a center through hole 31 disposed in line with the center through hole 11, which receives the stepped contact metal cylinder 5, two opposite outside ribs 32 respectively engaged into the two opposite grooves 111 on the insulative outer shell 1, a plurality of side holes 33, each of which receives a respective capacitor element 4, a stop flange 34 raised around the periphery, which supports the contact metal spring 2 in position, and two opposite sliding grooves 311 on the inside of the center through hole 31 for the sliding of the stepped contact metal cylinder 5. When assembled, the capacitor elements 4 in the side holes 33 are respectively disposed in contact with the pegs 22 of the contact metal spring 2.

The capacitor elements 4 are of known, commercially available form, respectively inserted into the side holes 33 on the insulative inner shell 3 and disposed in contact with the pegs 22 of the contact metal spring 2 to filtrate noise.

The stepped contact metal cylinder 5 comprises a stepped center through hole 54 through the central axis thereof, two opposite guide blocks 51 on the outside near the front end thereof moved to slide in the sliding grooves 311 of the insulative inner shell 3, each guide block 51 having a respective half-round recess 511 into which either earth contact leg 13 is inserted, a resistor mounting hole 53 through the peripheral wall thereof in the middle in communication with the center through hole 54, which receives the resistor element 6, a plurality of capacitor mounting holes 52 communicated with the stepped center through hole 54 and respectively aligned with the side holes 33 on the insulative inner shell 3 to hold the capacitor elements 4. The resistor mounting hole 53 is sealed by a solder after the resistor element 6 is inserted into the resistor mounting hole 53.

The insulative hollow insert 7 is molded from a high polymer in a profile fitted into the stepped center through hole 54 of the stepped contact metal cylinder 5, comprising an axial center through hole 71 through which the central contact 8 is inserted, a half-round projection 72 longitudinally projecting from one end thereof for coupling with the insulative hollow core 9.

The central contact 8 is made of an elongated metal rod, comprising a hollow split head 81, and a unitary projecting spring strip 82 extend from the hollow split head 81. When assembled, the rear end of the central contact 8 extends out of the insulative outer shell 1 and is bent at right angles (see FIGS. 2 and 3).

The insulative hollow core 9 is fabricated by molding, comprising a stepped center through hole 91 through the central axis thereof, through which the central contact 8 passes, a side hole 92 aligned with the resistor mounting hole 53 and communicated with the stepped center through hole 91, a side groove 93 through the peripheral wall thereof in the longitudinal direction in communication with the stepped center through hole 91, and a curved contact metal strip 94 fastened between the stepped center through hole 91 and the side groove 93 and disposed in contact with the resistor element 6.

The assembly process of the capacitive coupled BNC type self-terminating coaxial connector is outlined hereinafter. The curved contact metal strip 94 is fastened between the stepped center through hole 91 of the insulative hollow core 9 and the side groove 93 thereof. Then, the central contact 8 is inserted into the stepped center through hole 91 of the insulative hollow core 9 from the front end with the projecting spring strip 82 retained in the side groove 93 of the insulative hollow core 9. Then, the half-round projection 72 of the insulative hollow insert 7 is inserted into the stepped center through hole 91 of the insulative hollow core 9 from the rear end, and then the insulative hollow insert 7 and the insulative hollow core 9 are inserted into the center through hole 54 of the stepped contact metal cylinder 5. Then, the resistor element 6 is inserted into the resistor mounting hole 53 on the stepped contact metal cylinder 5 and the side hole 92 on the insulative hollow core 9 to contact the curved contact metal strip 94, and then the resistor element 6 is sealed in position by solder. Then, the guide blocks 51 of the stepped contact metal cylinder 5 are respectively inserted into the sliding grooves 311 on the insulative inner shell 3 for permitting the stepped contact metal cylinder 5 to be held within the insulative inner shell 3, and then the capacitor elements 4 are respectively inserted into the side holes 33 on the insulative inner shell 3 and the capacitor mounting holes 52 on the stepped contact metal cylinder 5. Then, an earth contact 55 is connected to the rear end of the stepped contact metal cylinder 5. Then, the insulative inner shell 3 is inserted into the center opening 21 of the contact metal spring 2 and the center through hole 11 of the insulative outer shell 1 for permitting the ribs 32 to be respectively engaged into the longitudinal grooves 111 and the contact metal spring 2 to be stopped between the insulative inner shell 3 and the insulative outer shell 1 and supported on the stop flange 34. As the contact metal spring 2 is retained in position, the pegs 22 of the contact metal spring 2 are disposed in contact with the capacitor elements 4. Finally, the earth contact legs 13 are respectively inserted in the plug holes 12 on the insulative outer shell 1 and engaged into the half-round recess 511 on either guide block 51 of the stepped contact metal cylinder 5.

When a matching connector is connected to the capacitive coupled BNC type self-terminating coaxial connector installed in a computer, with its central contact pin inserted into the hollow split head 81 of the central contact, the projecting spring strip 82 is caused to turn inward and to disconnect from the curved contact metal strip 94, and therefore the central contact 8 is disconnected from the earth contact legs 13 for letting the earth contact legs 13 be connected to earth. As the matching connector is disconnected, the projecting spring strip 82 automatically returns to its former position contacting the curved contact metal strip 94 again in forming a short circuit, and therefore the computer becomes inoperative. Further, the capacitive coupled BNC type self-terminating coaxial connector can effectively eliminate noises because the capacitor elements 4 are constantly disposed in contact with the stepped contact metal cylinder 5 and the contact metal spring 2.

Figure 4:
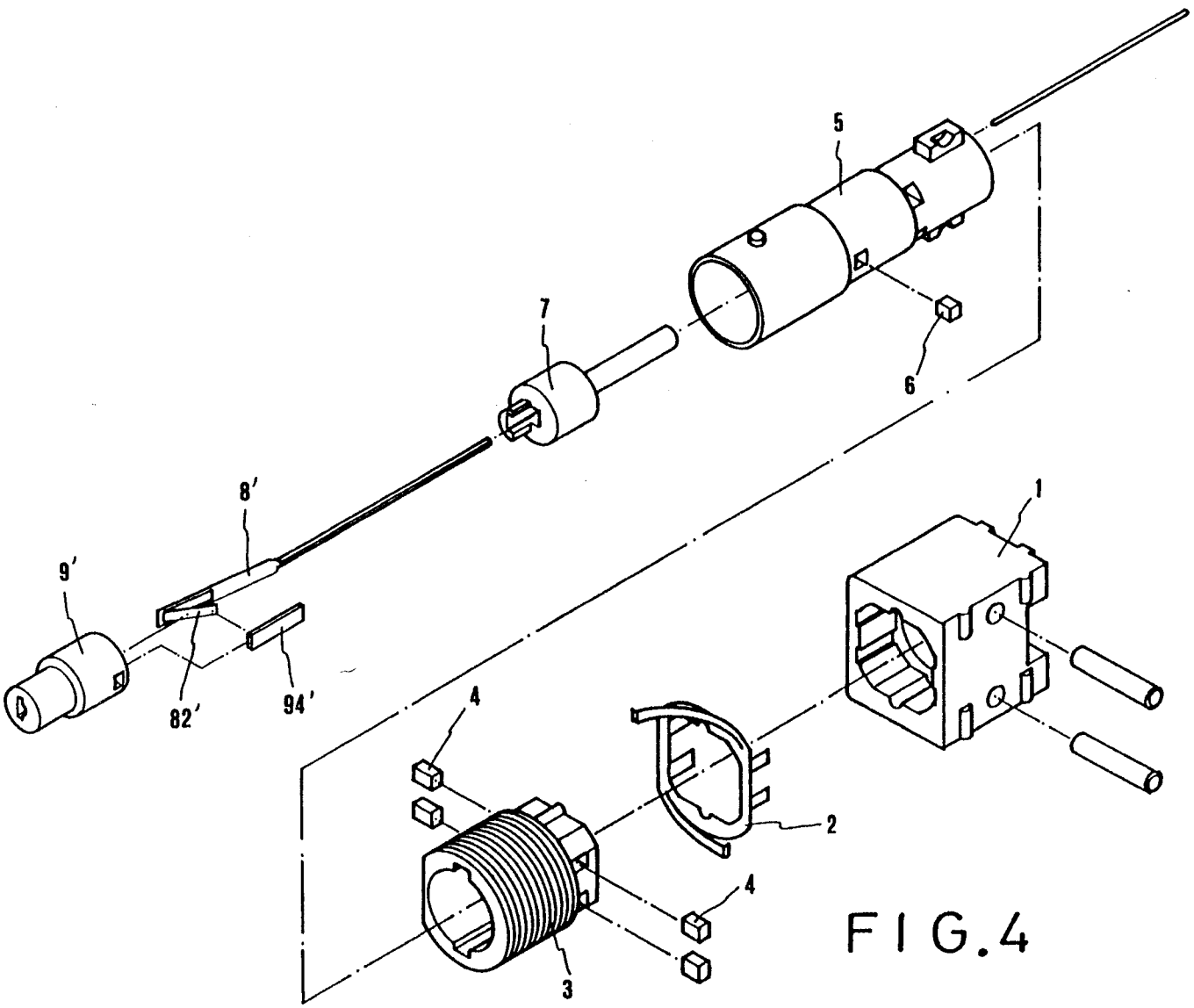
FIG. 4 is an exploded view of an alternate form of the capacitive coupled BNC type self-terminating coaxial connector of the present invention.
Figure 5:
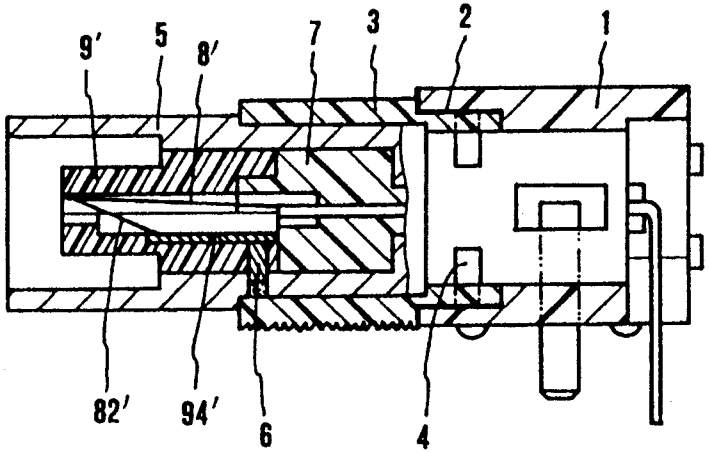
FIG. 5 is a perspective sectional side view of the capacitive coupled BNC type self-terminating coaxial connector shown in FIG. 4.

Referring to FIGS. 4 and 5, therein illustrated is an alternate form of the present invention, which is comprised of an insulative outer shell 1, a contact metal spring 2, an insulative inner shell 3, capacitor elements 4, a stepped contact metal cylinder 5, a resistor element 6, an insulative hollow insert 7, a central contact 8', and an insulative hollow core 9'. The central contact 8' and the insulative hollow core 9' are different in structure from the corresponding parts in the aforesaid first embodiment of the present invention, and the other parts or elements are identical to the corresponding parts or elements of the aforesaid first embodiment and respectively referenced by the corresponding reference numbers. In this alternate form, the insulative hollow core 9' eliminates the arrangement of the side groove 93 on the insulative hollow core 9 of the aforesaid first embodiment is eliminated, and the contact metal strip 94' is made of a flat strip. Further, the front end of the central contact 8' is made in a flat configuration, and the projecting spring strip 82' integrally projected from the flat front end of the central contact 8'. As a matching connector is connected by inserting its contact pin into the gap between the projecting spring strip 82' and the contact metal strip 94', the projecting spring strip 82' is disconnected from the contact metal strip 94'; on the contrary, as the matching connector is disconnected, the projecting spring strip 82' automatically returns to its former position to contact the contact metal strip 94' again.

As indicated, the present invention provides a capacitive coupled BNC type self-terminating coaxial connector having numerous features as follows:

a) Only the insulative inner and outer shells and the stepped contact metal cylinder are exposed to the outside, and therefore the connector has a smooth profile.

b) Capacitor and resistor elements are firmly retained in respective positions to eliminate any possible contact error.

c) The ribs on the insulative inner shell prohibit the contact metal spring from a rotary motion, and the stop flange of the insulative inner shell prohibits the contact metal spring from an axial movement, and therefore the contact metal spring is firmly retained in position.

d) The parts are connected by inserting one into another without the use of any screws or fastening elements, and therefore the whole assembly is easy to assemble and repair.

While only few embodiments of the present invention have been shown and described, it will be understood that various modifications and changes could be made without departing from the spirit and scope of the invention.

What is claimed is:

1. A capacitive coupled BNC type self-terminating coaxial connector comprising:

an insulative outer shell having a center through hole and two opposite longitudinal grooves within the center through hole;

an insulative inner shell having one end fitted into the center through hole on said insulative outer shell, said insulative inner shell having a center through hole;

a contact metal spring mounted around said insulative inner shell and retained between said insulative outer shell and said insulative inner shell;

a stepped contact metal cylinder received within said insulative inner shell, said stepped contact metal cylinder having capacitor mounting holes and a resistor mounting hole respectively communicated with a stepped center through hole thereof;

a plurality of capacitor elements respectively inserted in said capacitor mounting holes for eliminating noises;

a resistor element received in said resistor mounting hole;

an insulative hollow insert fabricated by molding and fitted into the stepped center through hole of said stepped contact metal cylinder, said insulative hollow insert having an axial center through hole;

an insulative hollow core connected to insulative hollow insert and received within said stepped contact metal cylinder, said insulative hollow core having an axial center through hole and a side hole aligned with said resistor mounting hole; and a central contact made of an elongated metal rod inserted through the axial center through hole on said insulative hollow core and the axial center through hole on said insulative hollow insert and disposed in contact with said capacitor elements;

wherein said insulative outer shell comprises two earth contact pins respectively inserted in two vertically spaced side holes on one lateral side thereof; said stepped contact metal cylinder comprises two opposite guide blocks respectively inserted into the longitudinal grooves on said insulative outer shell, each guide block having a recess which receives either earth contact pin; said contact metal spring comprises a plurality of contact pegs respectively disposed in contact with said capacitor elements; said insulative inner shell comprises a plurality of side holes respectively aligned with said capacitor mounting holes through which said capacitor elements are inserted into said capacitor mounting holes to contact said central contact; said insulative hollow core comprises a contact metal strip disposed in contact with said resistor element, said central contact comprises a projecting spring strip extended from a front end thereof and disposed in contact with said contact metal strip of said insulative hollow core as the capacitive coupled BNC type self-terminating coaxial connector does not work, said projecting spring strip of said central contact being separated from said contact metal strip of said insulative hollow core as the capacitive coupled BNC type self-terminating coaxial connector is connected with a matching connector.

2. The capacitive coupled BNC type self-terminating coaxial connector of claim 1 wherein said contact metal strip of said insulative hollow core is made of a curved metal plate fastened in a longitudinal side hole on said insulative hollow core and disposed in contact with said resistor element; said projecting spring strip integrally extends from a hollow split head of said central contact and disposed in contact with said contact metal strip of said insulative hollow core.

3. The capacitive coupled BNC type self-terminating coaxial connector of claim 1 wherein said contact metal strip of said insulative hollow core is made of a straight, flat metal strip fastened to said insulative hollow core on the inside and disposed in contact with said resistor element; said projecting spring strip integrally extends from a flat tip on one end of said central contact and disposed in contact with said contact metal strip of said insulative hollow core.

* * * * *